US009364038B2

(12) United States Patent
Barrett

(10) Patent No.: US 9,364,038 B2
(45) Date of Patent: Jun. 14, 2016

(54) LONG SLEEVED UPPER TORSO DETACHABLE HOODED GARMENT

(71) Applicant: David O A Barrett, Pompano Beach, FL (US)

(72) Inventor: David O A Barrett, Pompano Beach, FL (US)

( * ) Notice: Subject to any disclaimer, the term of this patent is extended or adjusted under 35 U.S.C. 154(b) by 0 days.

(21) Appl. No.: 14/169,141

(22) Filed: Jan. 30, 2014

(65) Prior Publication Data

US 2015/0208747 A1 Jul. 30, 2015

(51) Int. Cl.

| | |
|---|---|
| ***A42B 1/04*** | (2006.01) |
| ***A42B 1/00*** | (2006.01) |
| *A41D 15/00* | (2006.01) |

(52) U.S. Cl.

CPC ..... *A42B 1/048* (2013.01); *A41D 2200/20* (2013.01)

(58) Field of Classification Search

CPC ..... A41D 15/00; A41D 2200/20; A41D 2400/70; A41D 3/00; A41D 11/00; A41D 13/00; A41D 13/0005; A41D 13/1218; A41D 2300/32; A41D 2300/324; A41D 27/04; A41D 27/08; A41D 3/02; A42B 7/00

See application file for complete search history.

(56) References Cited

U.S. PATENT DOCUMENTS

| | | | | | |
|---|---|---|---|---|---|
| 2,372,110 | A | * | 3/1945 | Noone | 2/84 |
| 2,967,306 | A | * | 1/1961 | Fabanich | 2/94 |
| 3,736,595 | A | * | 6/1973 | Siegmann | 2/457 |
| D246,746 | S | * | 12/1977 | Dyer | D2/724 |
| 4,347,629 | A | * | 9/1982 | Itoi | 2/108 |
| 5,182,812 | A | * | 2/1993 | Goldsby | 2/79 |
| 5,673,836 | A | * | 10/1997 | Bush | 224/576 |
| 5,717,999 | A | * | 2/1998 | Lurry | 2/69 |
| 5,718,000 | A | * | 2/1998 | Ost et al. | 2/69 |
| 6,029,270 | A | * | 2/2000 | Ost et al. | 2/2.5 |
| 6,185,745 | B1 | * | 2/2001 | Alger | 2/107 |
| 6,263,509 | B1 | * | 7/2001 | Bowen | 2/69 |
| 7,028,342 | B1 | * | 4/2006 | Nordstrom et al. | 2/119 |
| D531,387 | S | * | 11/2006 | Pye et al. | D2/828 |
| 7,302,710 | B2 | * | 12/2007 | Thomas et al. | 2/84 |
| 7,823,220 | B2 | * | 11/2010 | Mazzarolo | 2/96 |
| 8,075,366 | B1 | * | 12/2011 | Jaksic et al. | 450/30 |
| D655,894 | S | * | 3/2012 | Crye | D2/831 |
| 8,650,662 | B2 | * | 2/2014 | Decker | 2/16 |
| D708,822 | S | * | 7/2014 | Douglas | D2/880 |
| 2005/0217004 | A1 | * | 10/2005 | Haberfeld | 2/69.5 |
| 2008/0115254 | A1 | * | 5/2008 | Galkov | 2/108 |
| 2009/0255029 | A1 | * | 10/2009 | Aldridge | 2/81 |

* cited by examiner

*Primary Examiner* — Bobby Muromoto, Jr.

(74) *Attorney, Agent, or Firm* — Patents on Demand P.A.; Brian K. Buchheit; Scott M. Garrett

(57) ABSTRACT

A long sleeved upper torso hooded garment which is worn by a user and comprising a detachable hood, the detachable hood including a top head portion, two opposed lateral portions, a back head portion, wherein there is a natural pocket portion in the back head portion of hood, above the hem or elastic neckline member, giving the natural pocket portion the ability to accommodate at least some of a user's loose hair; a front head opening portion, and a neck portion circumferentially extending around user's neck, the hood including a circumventing channel that encloses a drawstring at the edge of facial opening which is used to decrease the size of the facial opening, the upper torso portion of garment includes four openings, the two opposed lateral portions for allowing the users arms to pass through ending at the wrists' opening, the top opening for connecting the torso piece to the base of hood piece, and the bottom largest opening in which the user places the head, arms, and upper torso through to put on, or take off garment.

19 Claims, 5 Drawing Sheets

LONG SLEEVED UPPER TORSO DETACHABLE HOODED GARMENT

FIELD OF APPLICATION

The present application relates to a long sleeved upper torso hooded garment to be worn by men and women to protect the wearer from the elements such as wind, rain, cold, sun, or even as an accessory to be worn above or below most regularly worn t-shirts.

BACKGROUND OF THE ART

A common issue, for men and women, is that wearing only one piece of shirt item can get boring after a while. Sometimes wearing too much or too little top clothing can become uncomfortable. You can be too hot or too cold. Some elements can even affect your eyesight. Traditional hooded garments tend to be full length shirts or sweatshirts where they can be too bulky when worn under other garments. They are also typically not suited for all weather conditions and are either meant to be worn in hot or cold weather.

Similarly, in activities such as sports or working out at the gym where having the choice between wearing a hooded garment would be a welcomed option. A need exists for a hooded garment which overcomes the problems set forth above.

SUMMARY OF THE APPLICATION

Therefore it is the aim of the present disclosure to provide a long sleeved upper torso detachable hooded garment that addresses issues associated with the prior art.

Thus, in accordance with the present application, there is provided a long sleeved upper torso hooded garment which is worn by a user and comprising a detachable hood, the detachable hood including a top head portion, two opposed lateral portions, a back head portion, wherein there is a pocket portion in the back head portion of hood, above the hem or elastic neckline member, giving the natural pocket portion the ability to accommodate at least some of a user's loose hair; a front head opening portion, and a neck portion circumferentially extending around user's neck, the hood including a circumventing channel that encloses a drawstring at the edge of facial opening which is used to decrease the size of the facial opening, the upper torso portion of garment includes four openings, the two opposed lateral portions for allowing the users arms to pass through ending at the wrists' opening, the top opening for connecting the torso piece to the base of hood piece, and the bottom largest opening in which the user places the head, arms, and upper torso through to put on, or take off garment.

In accordance with the present application, there is further provided a method for putting on a long sleeved hooded garment, the method comprising inserting one's head through a first opening in the hooded garment, with a hood being in front of the head when the head is in the first opening, pulling a hood of the hooded garment over one's head with the head entering the hood through the second opening, such that a face opening in the hooded garment is aligned with a user's face, and closing the second opening, while also depicting the user placing right and left arms through each of the torso's lateral sleeve openings.

DESCRIPTION OF THE PREFERRED EMBODIMENTS

Figure 1:
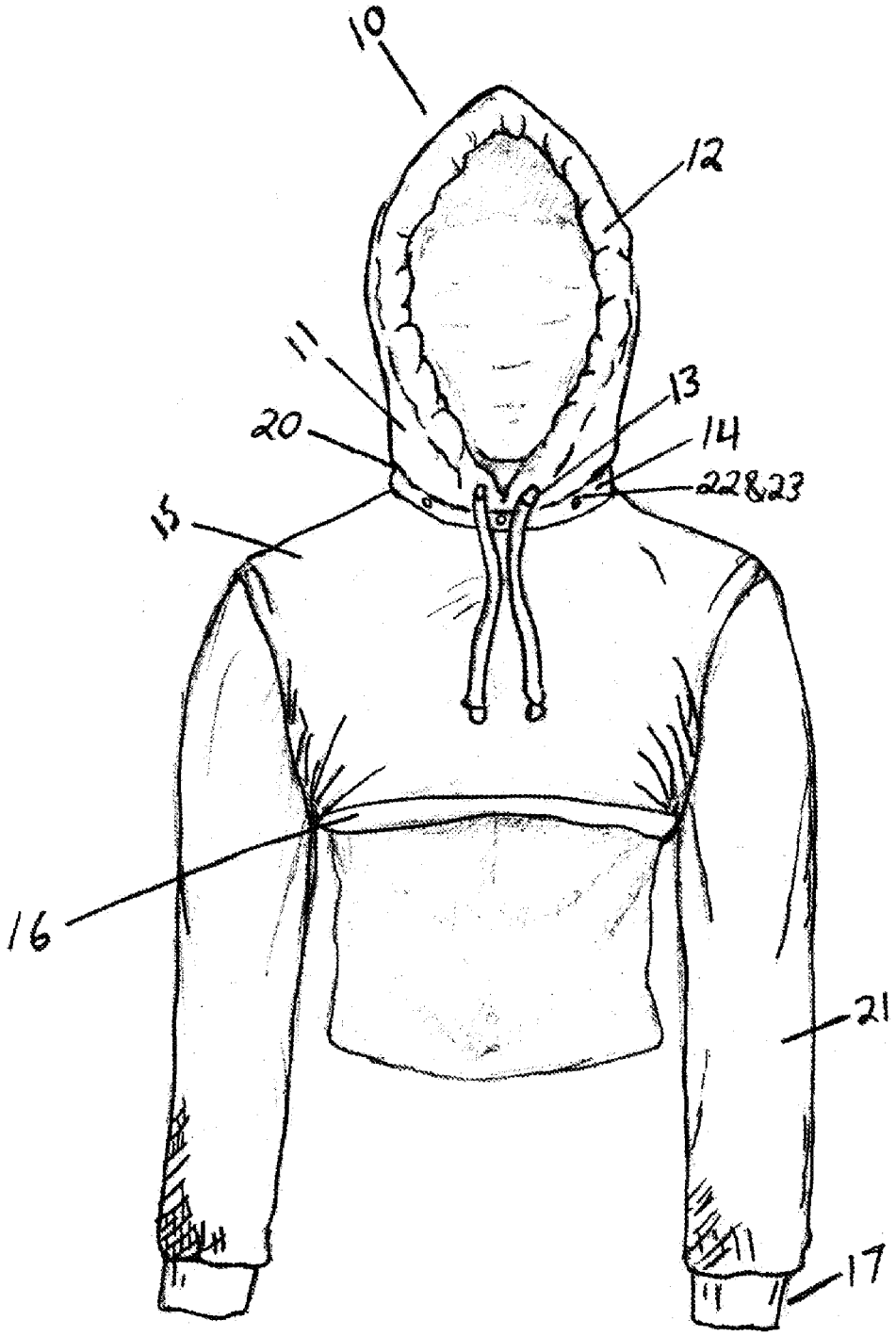
FIG. 1 is a perspective front view of a long sleeved hooded garment in accordance with an embodiment of the present application.

Referring to the drawings, and more specifically to FIG. 1, a long sleeved upper torso detachable hooded garment in accordance with the present disclosure is generally shown at 10. The long sleeved upper torso detachable hooded garment 10 is used to cover the head, neck, arms, and a portion of the torso of a wearer. The long sleeved upper torso detachable hooded garment 10 is particularly suited for athletic activities.

The long sleeved upper torso detachable hooded garment 10 has a detachable hood 11, a torso support portion 15 (FIGS. 1-2C), a detachable neck portions 14&20 wherein 14 comprises neck line of support portion 15 and 20 comprises neck line of hooded portion 11, and sleeves portion 21.

The detachable hood 11 covers the head of the wearer and holds the loose hair of the wearer in a generally stable position within the interior of the hood 11.

The long sleeved upper torso support portion 15 attaches the hooded portion 11 of garment on the torso of the wearer. In the embodiment shown, the torso support portion 15 attaches to the hooded portion 11 at the neckline 14 of the wearer, in order to be secured thereto. In another embodiment, the detachable hooded portion 11 may be used without a torso support portion 15 and solely including a hood 11 and a neck portion 20. Adversely in another embodiment, the torso support portion 15 may be used without a hooded portion 11 and solely including a upper torso support portion 15 and neck portion 14.

The neck portion 20 interconnects the hood 11 at the torso support portion 14 and accommodates the neckline of the wearer.

Figure 3D:
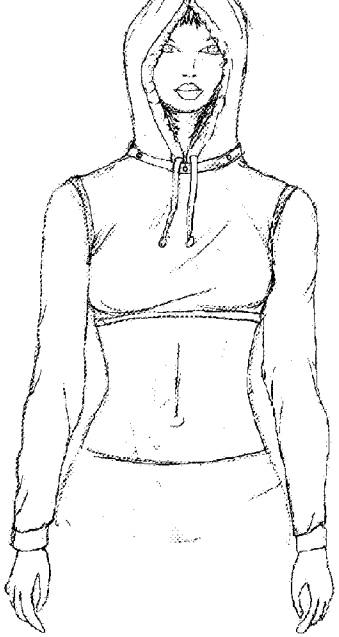
FIGS. 3A-3D are a schematic sequence of a user person in the process of putting on the hooded garment.
Figure 3C:
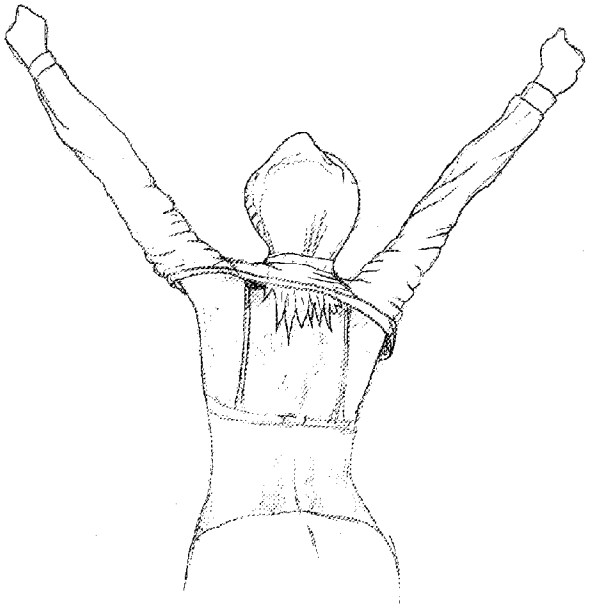

Referring to FIG. 1, the long sleeved upper torso detachable hooded garment 10 has a detachable hood 11 with a back head portion, a top portion, a front head portion, and lateral portions, in addition to the neck portion 20. The hood 11 is sized to anatomically conform to the head of the wearer, with the exception of a natural pocket, as mentioned below. Accordingly, the hood 11 may come in different sizes and/or different geometries and/or different textile materials comprising electrometric fibers. A face opening & drawstring channel and drawstring 12 is defined in the front head portion. An eyelet or opening 13 demonstrates where the drawstring enters or exits the drawstring channel 12 just above the center neckline area 14&20. The face opening & drawstring channel and drawstring 12 can be sized by means of a drawstring material to allow a portion of the face of the wearer to be exposed when the hooded garment portion 10 is worn. In one embodiment, as shown in FIG. 3D, an upper peripheral edge of the face opening & drawstring channel 12 is above the brows of the wearer, while a lower peripheral edge of the face opening is below the chin. Other sizes are considered as well, for instance, to cover most of the face of the wearer with the exception of the eyes, for protection in cold-weather use, or for covering one's face (e.g., facial protection, mask, religious requirements).

A sewn hem 16 or can be elastic waistband comprises the lower bottom of the torso support portion 15.

A sewn cuff 17 or can be hemmed cuff is demonstrated at end of each sleeve of the upper torso support portion 15.

Figure 2C:
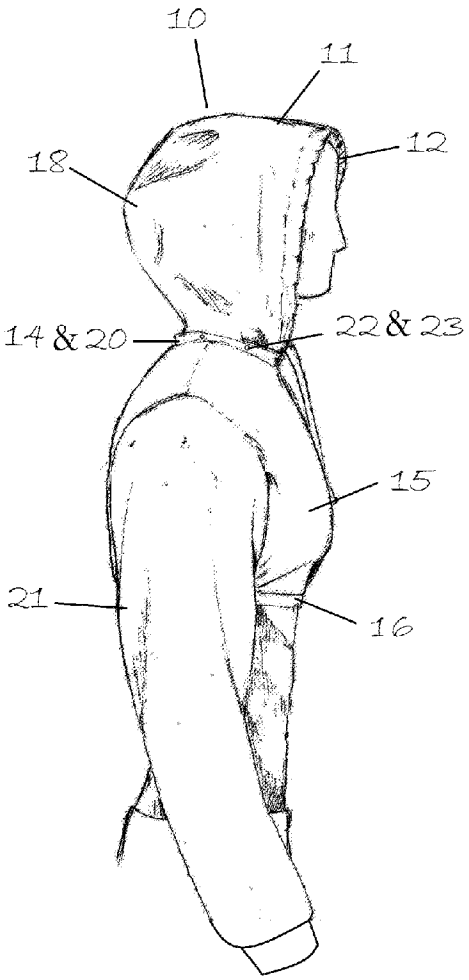
FIG. 2C is a schematic elevation view of the hooded garment of FIG. 2A as reattached and ready for use.
Figure 2B:
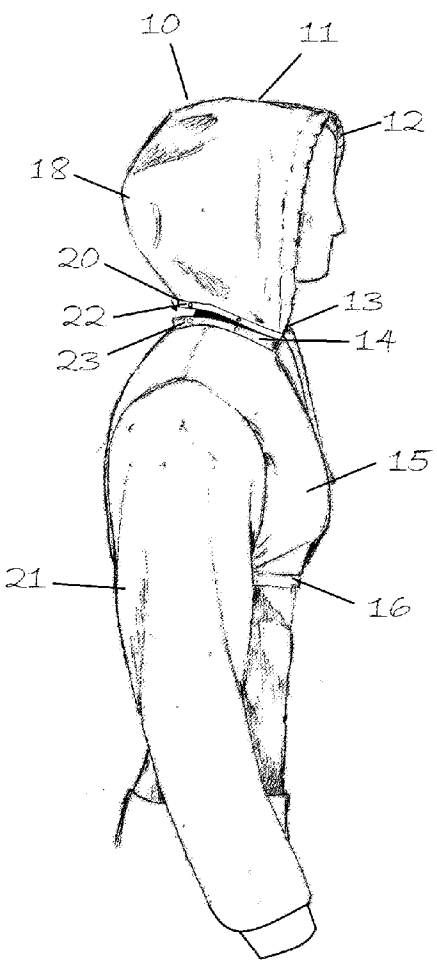
FIG. 2B is a schematic elevation view of the hooded garment of FIG. 2A being reattached to the torso portion of hooded garment at the neck line by means of button snaps.
Figure 2A:
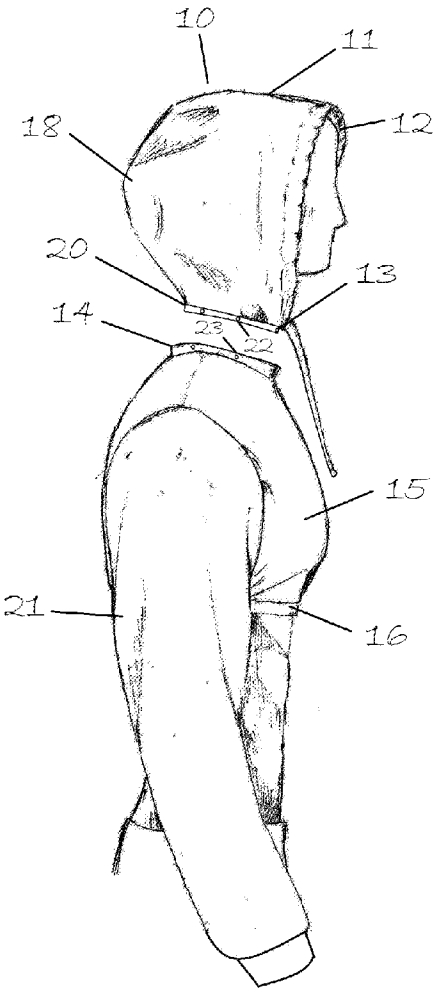
FIG. 2A is a schematic side view of the hooded garment of FIG. 1, with the hood detached from torso portion of hooded garment.

A natural pocket 18 as shown in FIG. 2A-2C is positioned in the back head portion of the hood 11. The natural pocket 18 is a cavity defined by additional material in this area of the hood with regard to the usual anatomy of the back of the head of the wearer. Accordingly, the cavity is defined as a natural pocket as it accommodates the loose hair of the wearer, such as a ponytail, long hair, mullet, or the like.

As illustrated in FIG. 2B, the fastener 22 may be a button system (including one or more buttons and appropriate slits), or any other appropriate fastener such as Velcro™, a zipper closure or the like. The male fastening system 22 of hood portion 11 is sewn onto the inside of outer edge of fabric hem allowing male side to face outward. While the female fastening system 23 of the torso portion is sewn inside the inner edge of fabric hem allowing female side to face inward to the neckline.

Referring to FIGS. 2A-2C, the above-referred components of the hood 11 and torso portion 15 are illustrated, and the method of closing the opening between the hood fasteners and torso neckline fasteners is described.

Figure 4:
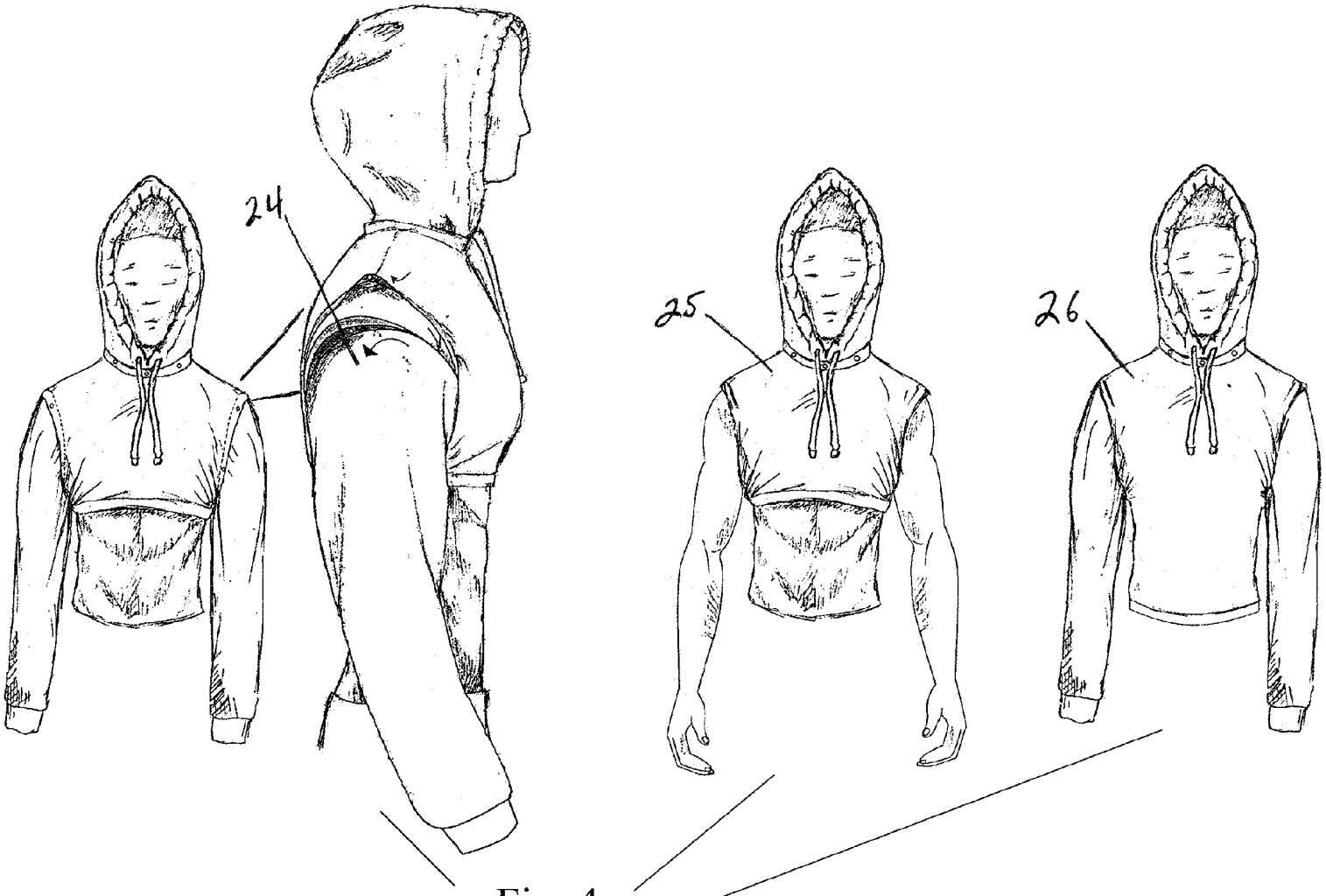
FIG. 4 is a schematic view of different embodiments of a torso support portion, which may include no sleeves, detachable sleeves, and/or full-length torso support, of the hooded garment of FIG. 1.

If the long sleeved upper torso detachable hooded garment 10 has a torso support portion 15, referring to FIG. 4, the hooded garment 10 is shown having different configurations for the torso support portion 15. The torso support portion 15 may have arm openings 24, a breast section 25, and a stomach section 26, of different shapes and lengths. The torso support portion 15 may have sleeves of different lengths, such as full length, short, or may alternatively be sleeveless 25. In one embodiment the long sleeves can have a method for attaching and detaching sleeves 24 from shoulder similar to that of the hood 20 and torso 14 attaching area.

The long sleeved upper torso detachable hooded garment may be made using various materials, including one of or a combination of textile materials generally used for athletic ware or for various other uses, such as stretchable fabrics, for example spandex, or a mixture of spandex and other materials such as polyester, woven, knitted, non-woven fibers and finishes. In one embodiment, the material may be elastic and air-breathable.

Now that the long sleeved upper torso detachable hooded garment 10 and its various possible components have been described, there is illustrated a sequence of installation of the hooded garment by a user person.

Figure 3B:
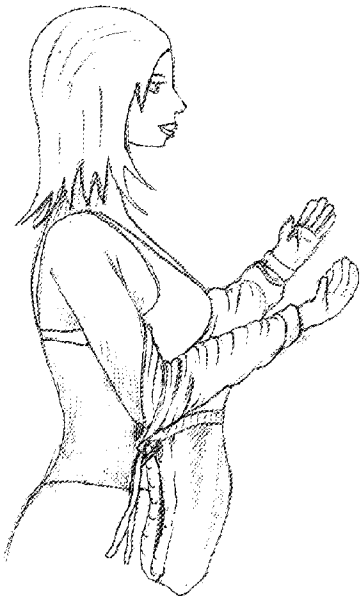
Figure 3A:
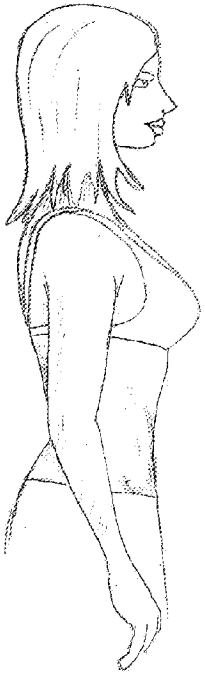

In FIG. 3A, the user person is illustrated without the long sleeved upper torso detachable hooded garment 10. The user person may have various undergarments, such as a bra, as shown in FIG. 3A.

In FIG. 3B, the long sleeved upper torso detachable hooded garment 10 is put on by the wearer such that the torso support portion 15 covers the upper torso of the wearer. According to an embodiment, the head of the wearer passes through the opening 14 such that the hood 11 is in front of the wearer, who can easily manipulate the various components of the hood 11.

From FIG. 3A to FIG. 3D, the hood 11 is flipped over the head of the wearer, such that the head is tucked into the hood 11 and the wearers loose hair is tucked into the natural pocket 18, with the face aligned with the face opening. During this sequence, the hood portion 11 confines the wearers hair inside the hood and holds the hair in place there against.

At that moment, the sequence of closing as shown in FIGS. 2A-2C is applied, if not already done, and as shown in FIG. 2B & 2C, the fasteners 22 & 23 are closed, thereby closing the opening and connecting the two portions 11 & 15.

Figure 5C:
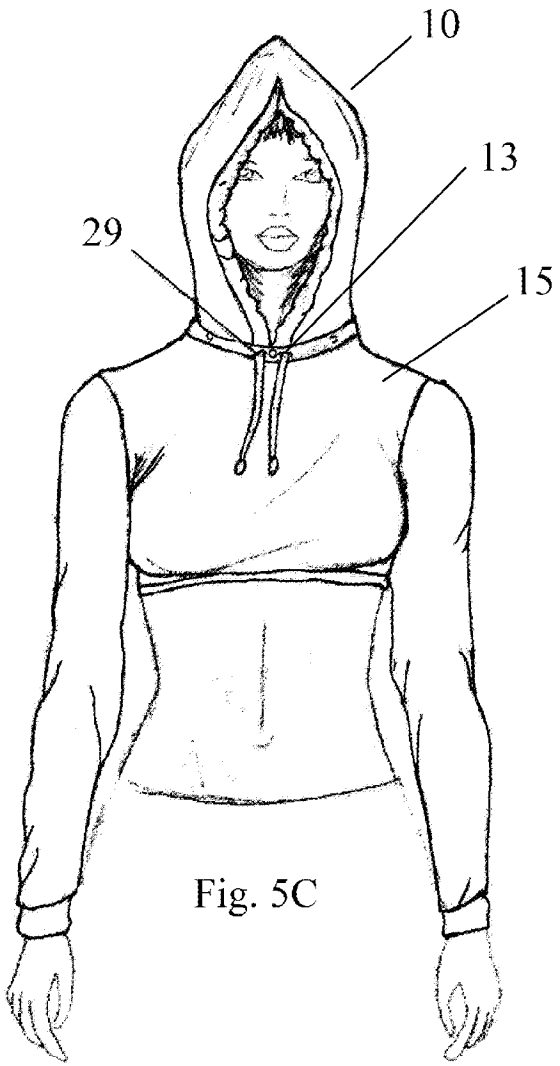
FIGS. 5A-5C is a schematic view of hooded garments button snaps placement in relation to neckline areas of hood and torso support portion, and an alternate embodiment of the garments drawstring exiting trough opening/eyelet at center neckline of torso support portion.
Figure 5A:
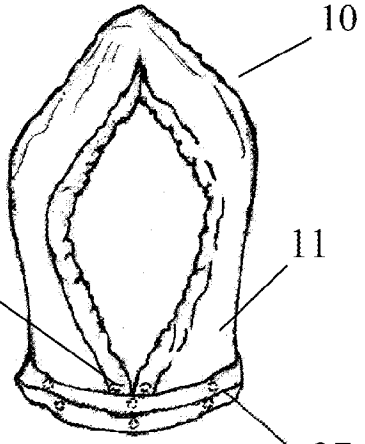

In FIG. 5A, is a front facing view of hooded garment 10 showing button snap placement 27 detached from torso support portion 15.

Figure 5B:
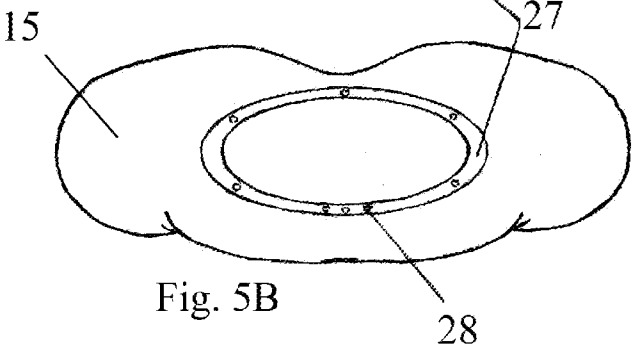

In FIG. 5B, is a top view of the upper torso support portion 15 showing button snap placement 27 detached from hood portion 11, as well as an alternative eyelet/opening placement 28 for drawstring exit 13.

In FIG. 5C, is a front facing view of a user person wearing hooded garment 10, as well as an alternate embodiment of eyelet/opening 29 for drawstring exit 13 on neckline area of torso support portion 15.

The invention claimed is:

1. A long sleeved upper torso hooded garment, comprising:

a detachable hood including a top head portion, two opposed lateral portions, and a back head portion, wherein the back head portion of hood comprises additional material relative to a back portion of a wearer's head so as to form a pocket;

a front head opening portion formed in a front of the detachable hood and including a channel that encloses a drawstring that around the front head opening portion, wherein the channel has two ends with each end terminating at a respective eyelet opening at a bottom of the front head opening;

a neck portion circumferentially extending around a base of the detachable hood;

an upper torso portion that is separate from the detachable hood and that includes four openings, including two opposed lateral portions configured to allow the wearer's arms to pass through, and ending at a wrists' opening, a top opening at a neck portion of the upper torso portion for connecting the upper torso portion to the neck portion of the detachable hood, and a bottom opening wherein the neck portion of the upper torso portion includes two alternate eyelet exits, each of which correspond to a respective one of the eyelet openings of the detachable hood and are located to allow the drawstring to continue from the eyelet openings of the detachable hood through the alternate eyelet exits.

2. The hooded garment according to claim 1, wherein the hooded garment comprises a torso support portion connected to the neck portion of the upper torso portion, by which the hooded garment is retained on the wearer.

3. The hooded garment according to claim 2, wherein the torso support portion includes two arm openings configured to allow a wearer's arms pass through and thereby retain the hooded garment on the wearer.

4. The hooded garment according to claim 3, wherein the sleeves of the torso support portion ends with either a sewn cuff or hemmed cuff.

5. The hooded garment according to claim 2, wherein the hooded garment includes fastener means that circumvent the neck portions of both hooded portion and upper torso portion.

6. The hooded garment according to claim 5, wherein the fastener means is made of one of metal, plastic, hook and loop fastener, zipper, or sewn buttons, wherein the sewn buttons include at least one button on a first side of any area, at least one slot corresponding to the at least one button being formed on the second side of the back opening, the first side of the back opening being attachable to the second side of the back opening by inserting the at least one button into the at least one slot going all around circumference of neckline of the two members.

7. The hooded garment according to claim 1, wherein the bottom opening below a breast area at a distance configured to expose an abdominal region of a wearer.

8. The hooded garment according to claim 1, wherein the bottom opening is either a hemmed or an elastic waistband.

9. The hooded garment according to claim 1, wherein sleeve portion is detachable from the torso support portion.

10. The hooded garment according to claim 1, wherein torso support portion is a full length shirt.

11. The hooded garment according to claim 1, wherein the torso support portion does not have sleeves.

12. A hooded garment system, comprising:

a detachable hood including a top head portion, two opposed lateral portions, and a back head portion, wherein the back head portion of hood comprises additional material relative to a back portion of a wearer's head so as to form a pocket in the detachable hood, the detachable hood further including a neck portion formed around a base of the detachable hood and a front head opening having a front edge in which a channel is formed and in which is disposed a drawstring, the channel is terminated at two opposing eyelet openings at a base of the detachable hood;

an upper torso portion having a neck portion configured to allow attachment of the detachable hood, and further having opposing arm holes each configured to accommodate an arm of a wearer at a shoulder of the wearer, and further comprising eyelets in the neck portion of the upper torso portion, each of the eyelets in the neck portion located to align with a respective one of the eyelet openings of the detachable hood, and configured to allow the drawstring to be threaded through them; and a torso portion that extends down from the upper torso portion and having a bottom opening configured to accommodate a torso of the wearer.

13. The hooded garment system of claim 12, wherein the torso portion is sized to expose a midriff of the wearer and extends below a breast region by one to three inches.

14. The hooded garment system of claim 12, wherein the torso portion extends down from the upper torso portion and is configured to end at approximately a waist of the wearer.

15. The hooded garment system of claim 12, further comprising a sleeve extended from each arm hole of the upper torso portion.

16. The hooded garment system of claim 12, wherein the hooded garment system lacks sleeves.

17. The hooded garment system of claim 15, wherein the sleeves each end with either a sewn cuff or hemmed cuff.

18. The hooded garment system of claim 12, wherein the detachable hood is attached to the upper torso portion at the neck portions by a fastener means that is one of a hook and loop fastener, a zipper, or buttons.

19. The hooded garment system of claim 18, wherein the buttons include at least one button on a first side of any area, at least one slot corresponding to the at least one button being formed on the second side of the back opening, the first side of the back opening being attachable to the second side of the back opening by inserting the at least one button into the at least one slot.

* * * * *